US005809735A

United States Patent [19]

Leblanc

[11] Patent Number: 5,809,735

[45] Date of Patent: Sep. 22, 1998

[54] STEEL-WOOD SYSTEM

[75] Inventor: Marcel Leblanc, St. Nicolas, Canada

[73] Assignee: Les Bois Laumar Inc., Quebec, Canada

[21] Appl. No.: 787,125

[22] Filed: Jan. 22, 1997

Related U.S. Application Data

[63] Continuation-in-part of Ser. No. 699,243, Aug. 19, 1996.

[51] Int. Cl.[6] ..... E04C 3/292

[52] U.S. Cl. ..... 52/737.3; 52/729.4; 52/DIG. 6

[58] Field of Search ..... 52/729.2, 729.4, 52/730.7, DIG. 6, 737.3; 403/232.1

[56] References Cited

U.S. PATENT DOCUMENTS

| | | | |
|---|---|---|---|
| 3,242,788 | 3/1966 | Broder | 85/13 |
| 3,261,137 | 7/1966 | Jureit | 52/483 |
| 3,266,362 | 8/1966 | Carr | 85/13 |
| 3,309,833 | 3/1967 | Jureit . | |
| 3,498,170 | 3/1970 | Sanford | 85/13 |
| 3,531,901 | 10/1970 | Will et al. | 52/309 |
| 3,531,904 | 10/1970 | Sanford | 52/712 |
| 3,605,360 | 9/1971 | Lindal . | |
| 3,686,809 | 8/1972 | Lindal | 52/223 |
| 3,703,304 | 11/1972 | Losee | 287/20.92 L |
| 3,841,195 | 10/1974 | Jureit | 85/13 |
| 3,863,738 | 2/1975 | Molloy | 188/77 R |
| 3,874,263 | 4/1975 | Barth et al. | 85/13 |
| 3,910,153 | 10/1975 | Jureit | 85/13 |
| 4,078,673 | 3/1978 | Wilhelmi | 214/10.5 R |
| 4,079,656 | 3/1978 | Church | 85/13 |
| 4,165,672 | 8/1979 | Jureit et al. | 85/13 |
| 4,235,148 | 11/1980 | Menge | 52/712 |
| 4,239,122 | 12/1980 | Klein | 211/182 |
| 4,281,497 | 8/1981 | Luotonen et al. | 52/730 |
| 4,343,580 | 8/1982 | Moyer et al. | 52/715 |
| 4,546,579 | 10/1985 | Rionda et al. | 52/712 |
| 4,555,887 | 12/1985 | Rionda | 52/712 |
| 4,586,550 | 5/1986 | Kitipornchai | 144/353 |
| 4,653,242 | 3/1987 | Ezard | 52/727 |
| 4,738,071 | 4/1988 | Ezard | 52/732 |
| 4,862,667 | 9/1989 | Melland | 52/732 |
| 4,866,798 | 9/1989 | Harris . | |
| 5,006,006 | 4/1991 | Lehtonen | 403/283 |
| 5,060,441 | 10/1991 | Pichette | 52/404 |
| 5,076,175 | 12/1991 | Whatley, II . | |
| 5,079,894 | 1/1992 | Lau | 52/732 |
| 5,497,595 | 3/1996 | Kalinin . | |

FOREIGN PATENT DOCUMENTS

| | | | |
|---|---|---|---|
| PG 1606 | 7/1952 | Australia . | |
| 165619 | 10/1955 | Australia | 52/730.7 |
| 189272 | 3/1919 | Canada . | |
| 342532 | 6/1934 | Canada . | |
| 349832 | 4/1935 | Canada . | |
| 433984 | 4/1948 | Canada . | |
| 464942 | 5/1950 | Canada . | |
| 530376 | 9/1956 | Canada . | |
| 634108 | 1/1962 | Canada . | |
| 713746 | 7/1965 | Canada . | |
| 765147 | 8/1967 | Canada . | |
| 902330 | 6/1972 | Canada . | |

(List continued on next page.)

*Primary Examiner*—Carl D. Friedman
*Assistant Examiner*—Beth Aubrey
*Attorney, Agent, or Firm*—Griffin, Butler Whisenhunt & Szipl, LLP

[57] ABSTRACT

A web-reinforced wood joist defines a top edge surface, a bottom edge surface opposite to the top edge surface, a first lateral web surface, and a second lateral web surface opposite to the first lateral web surface. A longitudinal metal reinforcement is applied to at least one of the first and second lateral web surfaces. This metal reinforcement includes at least one sheet metal strip formed with integral teeth distributed at predetermined intervals along the entire length thereof and driven into the wood to fixedly secure the metal reinforcement to the joist's wood. This web-reinforcing method is suitable to reinforce any type of elongated structural wood members to improve their strength in bending, direct tension, direct compression, direct shearing and any combination thereof.

7 Claims, 6 Drawing Sheets

FOREIGN PATENT DOCUMENTS

| | | |
|---|---|---|
| 922082 | 3/1973 | Canada . |
| 957821 | 11/1974 | Canada . |
| 1120681 | 3/1982 | Canada . |
| 1159625 | 1/1984 | Canada . |
| 1163774 | 3/1984 | Canada . |
| 1187263 | 5/1985 | Canada . |
| 1196169 | 11/1985 | Canada . |
| 2156453 | 2/1996 | Canada . |
| 1047630 | 7/1953 | France . |
| 2039439 | 1/1971 | France . |
| 2021028 | 10/1970 | Germany . |
| 6413489 | 5/1965 | Netherlands . |
| 136809 | 2/1920 | United Kingdom . |
| 578546 | 7/1946 | United Kingdom . |

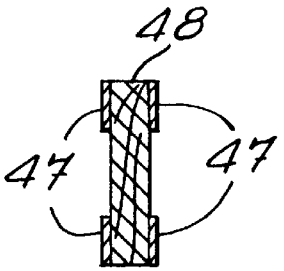
Fig. 8a
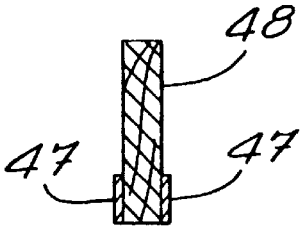
Fig. 8b
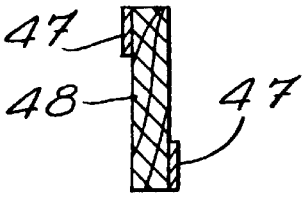
Fig. 8c
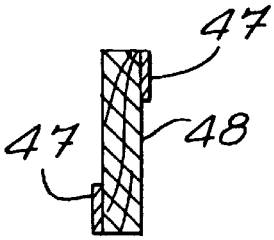
Fig. 8d
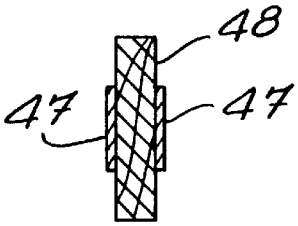
Fig. 8e
Fig. 9a
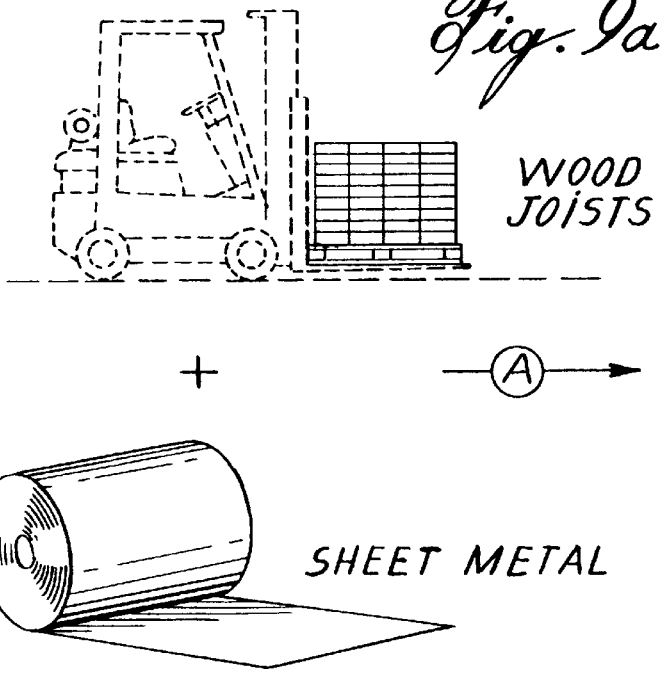

STEEL-WOOD SYSTEM

This application is a continuation-in-part application of U.S. application Ser. No. 08/699,243 filed on Aug. 19, 1996, which is still pending.

BACKGROUND OF THE INVENTION

1. Field of the Invention

The present invention relates to a steel-wood system, more specifically a method for web-reinforcing structural wood members, and to a structural wood member web-reinforced in accordance with this method.

2. Brief Description of the Prior Art

Structural lumber used throughout the world for constructing buildings is available on the market in a plurality of forms and wood species. However, due to the orthotropic properties of wood, some species cannot be used efficiently in many applications and/or under particular conditions. Also, visual grading of structural lumber using as criteria exterior wood appearance restricts the use of an important quantity of slightly affected structural lumber to applications in which the stresses involved are considerably lower. A considerable amount of structural lumber is also discarded due to natural imperfections such as shrinkage, cracks, knots, orientation of the fibers, warping, etc.

To obviate the above discussed disadvantages, U.S. Pat. No. 4,586,550 granted to Kitipornchai on May 6, 1986 proposes to reinforce an elongate structural wood member by mounting sheet metal strips or plates onto the top and/or bottom faces of the wood member. The sheet metal strips or plates are formed with a plurality of integral teeth extending on one side of the strip or plate, perpendicular thereto. In order to mount each sheet metal strip or plate, these teeth are driven into the wood member. Those of ordinary skill in the art will appreciate that these sheet metal strips or plates enhance the resistance of the wood member to bending.

Usually, an elongated structural wood member is, in cross section, wider than thick. Accordingly, the two edge surfaces of an elongated structural wood member are generally narrow and are used to secure a floor, a ceiling, a roof, wall covering, etc. Those of ordinary skill in the art will appreciate that metal sheet strips or plates applied to the top and bottom edge surfaces of a conventional floor joist (such as for example a wood joist 1½" thick and 7½" wide), in accordance with the teaching of U.S. Pat. No. 4,586,550 (Kitipornchai), interfere with fixation of the floor and ceiling onto the top and bottom narrow edge surfaces of the elongated structural wood member; an alternative method of fixation is required.

Also, use of sheet metal strips or plates onto only a portion of the length of the elongated structural wood member, as taught by U.S. Pat. No. 4,586,550 (Kitipornchai), creates mechanical disparities along the structural wood member. Moreover, there is no increase of the shearing stress the elongated structural wood member is capable of withstanding. Finally, the sheet metal reinforcement (strips or plates) cannot be installed onto the elongated structural wood members of an already erected construction.

Those of ordinary skill in the art will also appreciate that sheet metal reinforcement (strips or plates) as taught by U.S. Pat. No 4,586,550 (Kitipornchai) fails to uniformly compensate for the wood defects and therefore to improve the long term behaviour of the elongated wood members.

OBJECTS OF THE INVENTION

An object of the present invention is therefore to provide a steel-wood system capable of eliminating the above discussed drawbacks of the prior art.

Another object of the invention is to provide a method for web-reinforcing structural wood members that (a) increases the rigidity of the structural wood member, (b) improves the mechanical resistance thereof to bending stresses, shearing, direct compression, direct tension and any combination thereof, (c) fights directly the defects, natural or not, of wood, (d) raises the grade of the structural wood members, and (e) saves both wood and money.

A further object of the present invention is to provide a structural wood member web-reinforced in accordance with the above method.

SUMMARY OF THE INVENTION

More specifically, in accordance with the present invention, there is provided a method for web-reinforcing an elongated structural wood member defining first and second opposite edge surfaces, and first and second opposite web surfaces, comprising the steps of applying a longitudinal metal reinforcement to at least one of the first and second web surfaces, and fixedly securing this metal reinforcement to the wood of the structural wood member substantially over the entire length of the metal reinforcement.

Preferably but not exclusively, the metal reinforcement is fixedly secured to the wood of the structural member at predetermined intervals is substantially over the entire length of the metal reinforcement by means of metal teeth integral with the metal reinforcement.

Applying the metal reinforcement to at least one web surface of the elongated structural wood member and fixedly securing it to the wood substantially over the entire length of the metal reinforcement present, in particular but not exclusively, the following advantages:

- the rigidity of the structural wood member is increased;
- the mechanical resistance of the elongated structural wood member to bending stresses, shearing, direct compression, direct tension and any combination thereof is increased;
- the defects, natural or not, of wood are compensated for to thereby raise the grade of the structural wood members;
- etc.

The present invention also relates to a method for web-reinforcing a wood joist defining a top edge surface, a bottom edge surface opposite to the top edge surface, a first lateral web surface, and a second lateral web surface opposite to the first lateral web surface, comprising the step of applying a longitudinal metal reinforcement to at least one of the first and second lateral web surfaces, and fixedly securing this metal reinforcement to the wood of the joist at predetermined intervals along the length of the metal reinforcement by means of metal teeth integral to the metal reinforcement.

According to preferred embodiments:

- the applying step comprises applying a longitudinal sheet metal strip to the web surface;
- the joist comprises an upper longitudinal 90° edge connecting the web surface with the top edge surface and a lower longitudinal 90° edge connecting the web surface with the bottom edge surface, and the applying step comprises applying an upper longitudinal sheet metal strip to the web surface and placing an upper longitudinal edge of the upper sheet metal strip adjacent to the upper longitudinal 90° edge of the joist, and applying a lower longitudinal sheet metal strip to the web surface and placing a lower longitudinal edge of the lower sheet metal strip adjacent to the lower longitudinal 90° edge of the joist; and the metal reinforcement is made of sheet metal, the securing step comprises the step of stamping the teeth in the sheet metal, and the stamping step comprises stamping the teeth by pairs and making a sawtooth cut to simultaneously produce respective, generally diagonal sawtooth edges of both teeth of a pair.

Further in accordance with the present invention, there is provided a web-reinforced elongated structural wood member defining first and second opposite edge surfaces, and first and second opposite web surfaces, comprising a longitudinal metal reinforcement applied to at least one of the first and second web surfaces, and means for fixedly securing the metal reinforcement to the wood of the structural member substantially over the entire length of the metal reinforcement.

Preferably but not exclusively, the securing means comprises teeth formed integral with the metal reinforcement, distributed at predetermined intervals along the length of the metal reinforcement, and driven into the wood of the structural member to fixedly secure the metal reinforcement to the wood of the structural member.

The present invention still further relates to a web-reinforced wood joist defining a top edge surface, a bottom edge surface opposite to the top edge surface, a first lateral web surface, and a second lateral web surface opposite to the first lateral web surface, comprising a longitudinal metal reinforcement applied to at least one of the first and second lateral web surfaces, the metal reinforcement comprising integral metal teeth distributed at predetermined intervals along the metal reinforcement and driven into the wood of the joist to fixedly secure the metal reinforcement to the wood of the joist.

According to preferred embodiments of the web-reinforced wood joist:

the longitudinal metal reinforcement comprises a longitudinal sheet metal strip;

the joist comprises an upper longitudinal 90° edge connecting the web surface with the top edge surface and a lower longitudinal 90° edge connecting the web surface with the bottom edge surface, and the longitudinal metal reinforcement comprises an upper longitudinal sheet metal strip having an upper longitudinal edge adjacent to the upper longitudinal 90° edge of the joist, and a lower longitudinal sheet metal strip having a lower longitudinal edge adjacent to the lower longitudinal 90° edge of the joist;

the metal reinforcement is made of sheet metal, and the teeth are stamped in the sheet metal, each of the teeth comprises a generally diagonal sawtooth edge, the teeth are stamped by pairs in the sheet metal, and the sawtooth edges of both teeth of a pair is formed by a single cut in the sheet metal.

The objects, advantages and other features of the present invention will become more apparent upon reading of the following non restrictive description of preferred embodiments thereof, given by way of example only with reference to the accompanying drawings.

BRIEF DESCRIPTION OF THE DRAWINGS

In the appended drawings:

FIG. 8*a* is a cross sectional, elevational view of the embodiment of reinforced wood joist as illustrated in FIG. 1;

FIG. 8*b* is a cross sectional, elevational view of another embodiment of reinforced wood joist according to the invention;

FIG. 8*c* is a cross sectional, elevational view of a further embodiment of reinforced wood joist according to the invention;

FIG. 8*d* is a cross sectional, elevational view of still another embodiment of reinforced wood joist according to the invention;

FIG. 8*e* is a cross sectional, elevational view of a still further embodiment of reinforced wood joist according to the invention; and FIGS. 9*a* and 9*b* are a schematic representation of a process for manufacturing the reinforced wood joist of FIG. 1.

DETAILED DESCRIPTION OF THE PREFERRED EMBODIMENTS

Figure 1:
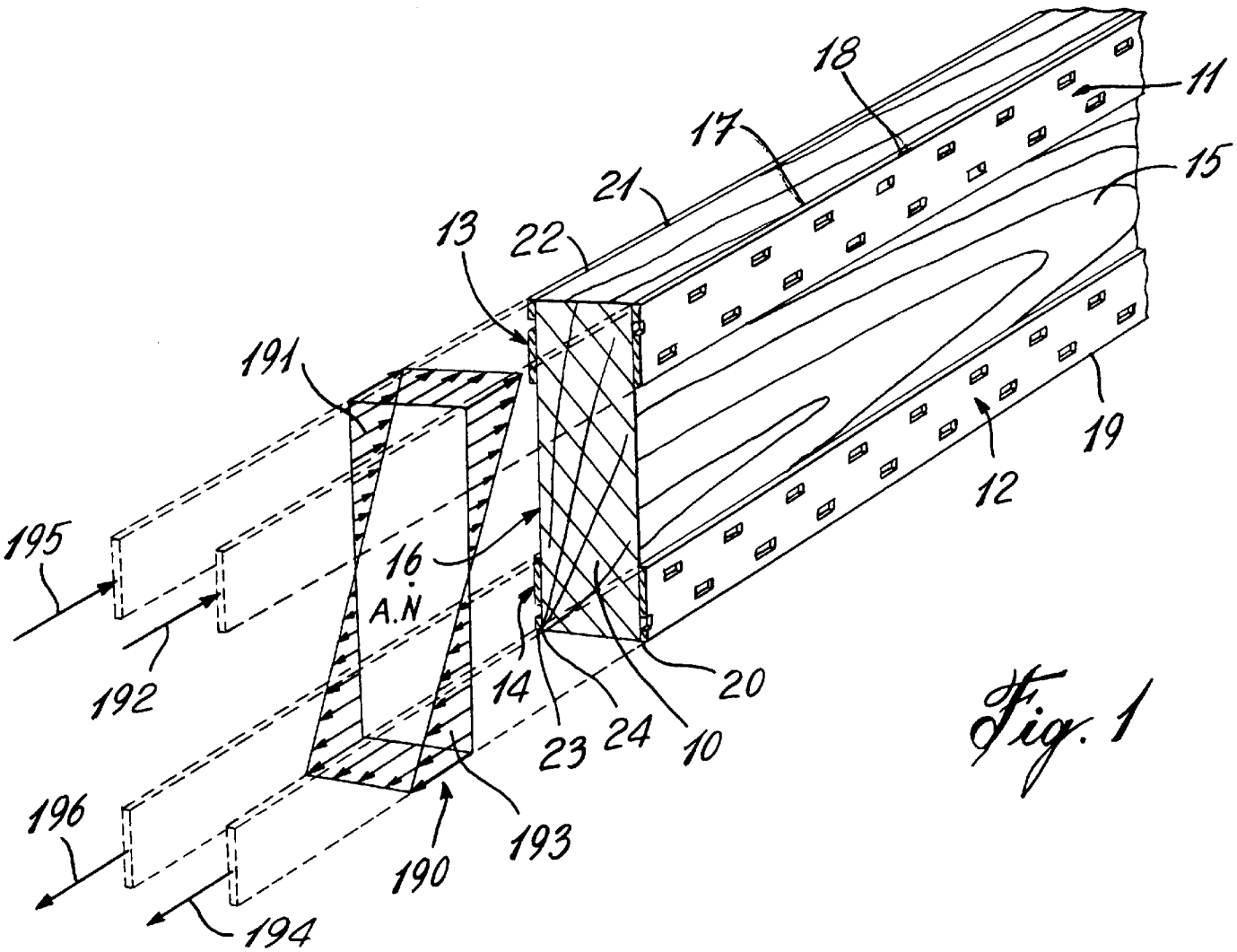
FIG. 1 is a partial perspective view of a first embodiment of reinforced wood joist in accordance with the present invention.

FIG. 1 of the appended drawings illustrates a floor joist 10 according to the invention, made of wood and reinforced with metal sheet strips 11–14 in accordance with the method of the invention. The metal of the strips 11–14 is preferably, but not exclusively steel.

As illustrated in FIG. 1, the joist 10 is, in cross section, wider than thick. It comprises two opposite web surfaces 15 and 16.

The sheet metal strip 11 is mounted longitudinally on the upper portion of the web surface 15, and comprises a longitudinal upper edge 18 adjacent to an upper longitudinal 90° edge 17 of the joist 10. As the bending stresses (see 190), more specifically the compression stresses (see 191) imposed to the joist 10 are concentrated in the upper portion of the joist 10, it is important to place the strip 11 as high as possible on the web surface 15 to enable this strip 11 to support a larger portion (see 192) of these compression stresses.

The sheet metal strip 12 is mounted longitudinally on the lower portion of the web surface 15, and comprises a longitudinal lower 90° edge 19 adjacent to a lower 90° edge 20 of the joist 10. As the bending stresses (see 190), more particularly the tension stresses (see 193) imposed to the joist 10 are concentrated in the lower portion of that joist 10, it is important to place the strip 12 as low as possible on the web surface 15 to enable this strip 12 to support a larger portion (see 194) of these tension stresses.

The sheet metal strip 13 is mounted longitudinally on the upper portion of the web surface 16, and comprises a longitudinal upper edge 21 adjacent to an upper longitudinal 90° edge 22 of the joist 10. As the bending stresses (see 190), more specifically the compression stresses (see 191) imposed to the joist 10 are concentrated in the upper portion of the joist 10, it is important to place the strip 13 as high as possible on the web surface 16 to enable this strip 13 to support a larger portion (see 195) of these compression stresses.

Finally, in the same manner, the sheet metal strip 14 is mounted longitudinally on the lower portion of the web surface 16, and comprises a longitudinal lower edge 23 adjacent to a lower longitudinal 90° edge 24 of the joist 10. As the bending stresses (see 190), more specifically the tension stresses (see 193) imposed to the joist 10 are concentrated in the lower portion of the joist 10, it is important to place the strip 14 as low as possible on the web surface 16 to enable this strip 14 to support a larger portion (see 196) of these tension stresses.

Those of ordinary skill in the art will appreciate that the strips 11 and 13 reinforce the wood of the upper portion of the joist 10 (see 192 and 195), subjected to compression stresses (see 191). Regarding the strips 12 and 14, they reinforce the wood of the lower portion of the joist 10 (see 194 and 196), subjected to tension stresses (see 193).

In accordance with the present invention, it is also a requirement that the strips 11, 12, 13 and 14 be fixedly secured to the wood of the joist 10 over substantially the entire length thereof.

To fixedly secure each strip 11–14 of sheet metal to the wood of the joist 10, each such strip is formed at predetermined intervals and throughout the length thereof with teeth which are driven into the wood of the joist 10. Other fixation means such as nails, screws, glue, etc. can also be contemplated.

Figure 2:
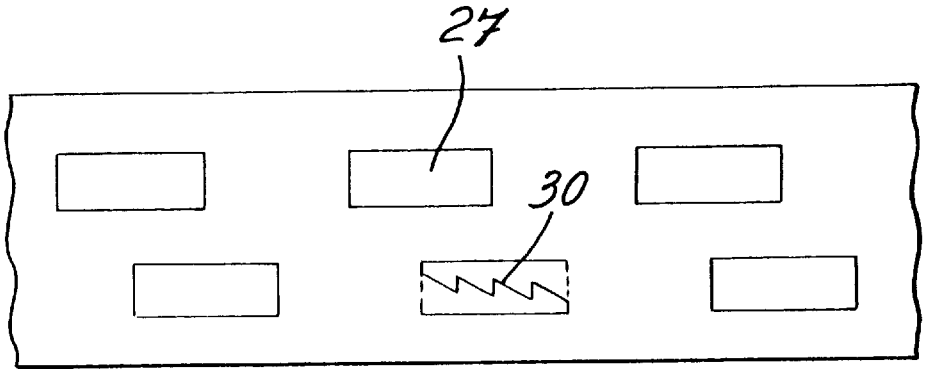
FIG. 2 is a partial plan view of a reinforcing sheet metal strip forming part of the reinforced joist of FIG. 1.
Figure 3:
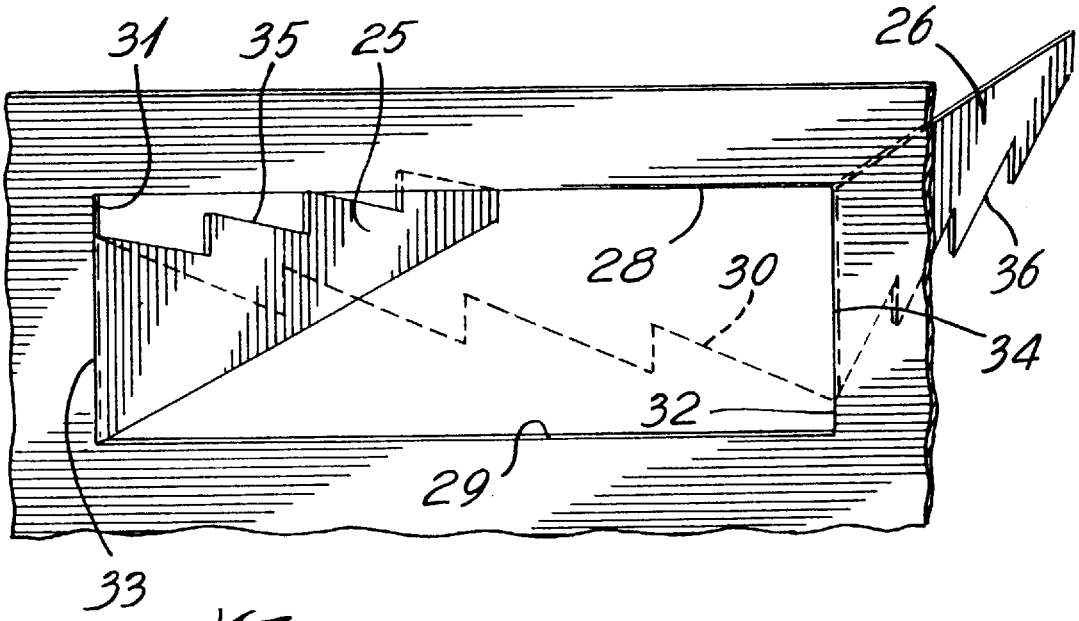
FIG. 3 is an enlarged, perspective view of a portion of the reinforcing strip of FIG. 2, showing a pair of stamped teeth each comprising a sawtooth edge.

In the embodiment of FIG. 1, the teeth such as 25 and 26 (FIGS. 2 and 3) are stamped into the sheet material. As illustrated in FIGS. 2 and 3, the teeth are stamped into the sheet metal by pairs. More specifically, each pair of teeth 25 and 26 is stamped into a rectangular area such as 27 of the corresponding strip 11, 12, 13 or 14.

During the stamping operation in each rectangular area 27, two straight cuts 28 and 29 are made to form two straight edges of the teeth 25 and 26, a diagonal sawtooth cut 30 interconnecting the opposite ends of the cuts 28 and 29 is made, and short cuts 31 and 32 are made to define the free ends of the two teeth 25 and 26, respectively. Also during the stamping operation, the base of each tooth 25 and 26 is bent along lines 33 and 34, respectively, until the teeth 25 and 26 reach a position generally perpendicular to the plane of the strip 11, 12, 13 or 14. As can be seen in FIGS. 2 and 3, a single sawtooth cut 30 enables obtention of both a sawtooth edge 35 of tooth 25 and a sawtooth edge of tooth 26. Those of ordinary skill in the art will appreciate that, after a tooth 25 or 26 has been driven into the wood material of the joist 10, the sawtooth edge 35 or 36 of that tooth 25 or 26, respectively, produce a fishhook effect on the wood fibers to retain the tooth into the wood. More specifically, the sawtooth edges 35 and 36 will prevent any withdrawal, even partial, of the teeth such as 25 and 26 whereby the strips 11–14 form with the joist 10 a substantially monolithic assembly. Retention of the teeth 25 and 26 in the wood is also improved by the relative positions of the sawtooth edges 35 and 36, that is substantially opposite to each other.

The structure of the teeth 25 and 26 presents, amongst others, the following advantages:

- a smaller area of sheet metal is required to form the teeth to thereby give to the strips 11–14 a higher strength;
- by means of a same diagonal sawtooth cut, two opposite sawtooth edges are produced;
- the cross section of the teeth increases from the free end to the strip at the same rate as the load to be withstood increases;
- the sawtooth structure of the teeth transfers the stresses in the wood by steps;
- the remaining, effective cross section of the strip is constant;
- the number of indentation of the sawtooth edge of the teeth may be easily adjusted as required; and
- the sawtooth edges provide a tooth-holding strength higher than that of the conventional teeth (approximately two times higher).

Of course, it should be understood that very strong fixation of the strips 11–14 to the wood of the joist 10 substantially over the entire length of these strips is required to enable the strips 11–14 to carry out their function, that is strengthening the wood joist 10. The above described teeth such as 25 and 26 in FIG. 3 have been designed for that purpose.

Figure 9B:
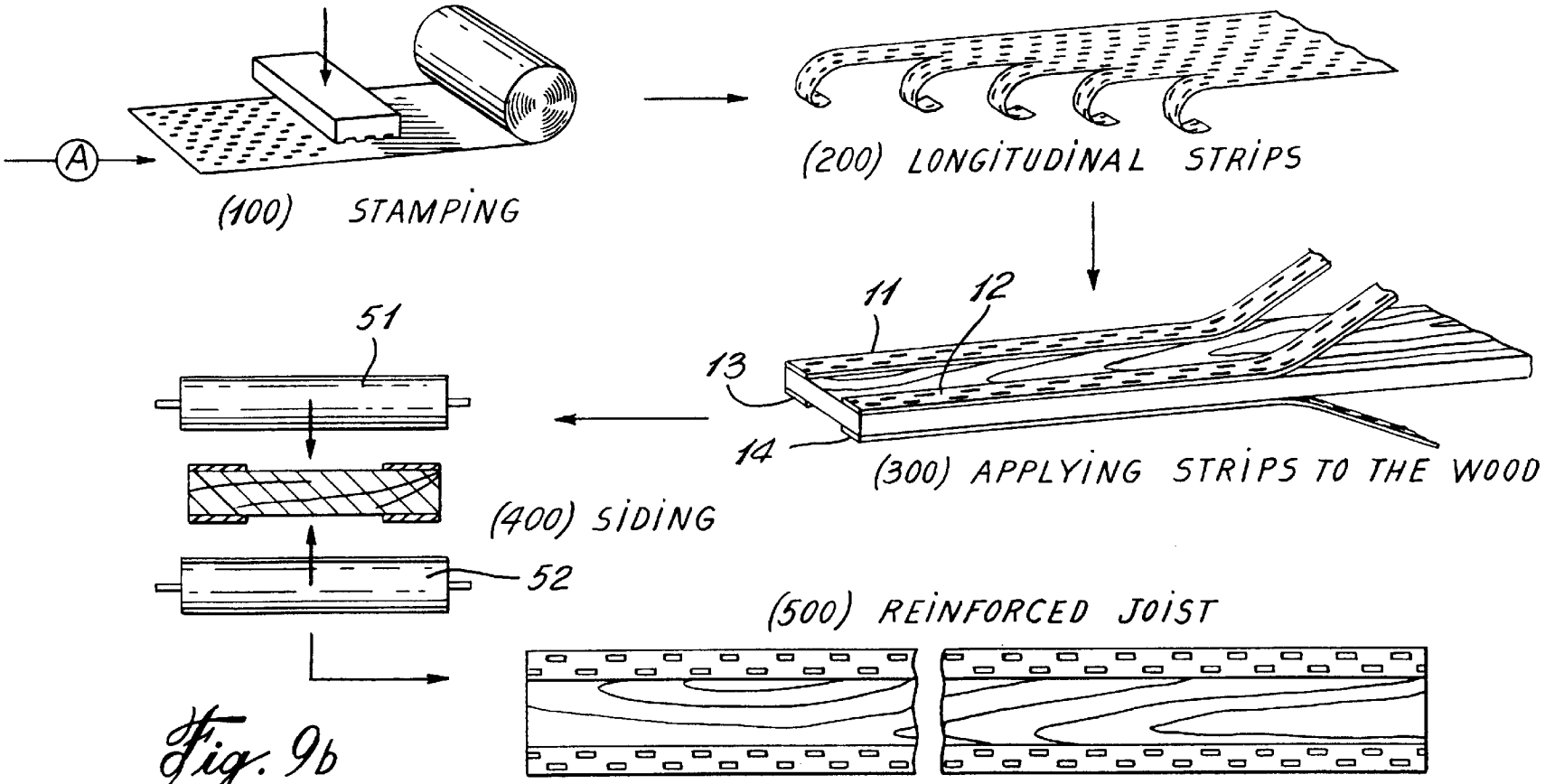

FIG. 9 illustrates a process for fabricating reinforced joists as illustrated in FIG. 1 from a supply of non reinforced wood joists 49 and a roll 50 of sheet metal.

In a first step 100, the roll 50 of sheet metal is stamped to produce the pairs of teeth 25 and 26 (FIGS. 2 and 3). Then, the stamped roll 50 of sheet metal is cut to produce longitudinal strips 11–14 of sheet metal each comprising respective pairs of teeth 25 and 26 (step 200). The strips 11–14 are applied (step 300) to the respective web surfaces 15 and 16 of the wood joist and a siding operation (step 400) using rollers 51 and 52 is used to drive the teeth 25 and 26 into the wood of the web surfaces of the joist. After the siding operation, fabrication of the reinforcing joist is completed (see 500).

Figure 4:
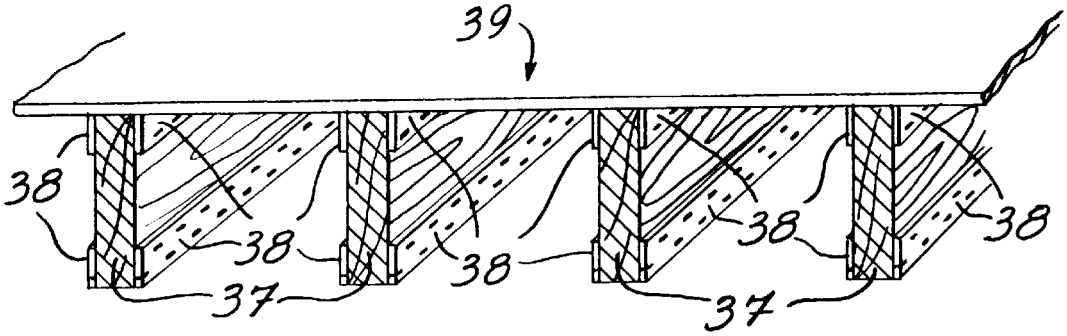
FIG. 4 is a partial perspective view of a floor structure comprising reinforced wood joists as illustrated in FIG. 1.

Referring to FIG. 4, the method in accordance with the present invention can be used to reinforce, in particular but not exclusively, the wood joists 37 of a floor structure 39 by means of sheet metal strips 38 as described in the foregoing description.

Figure 5:
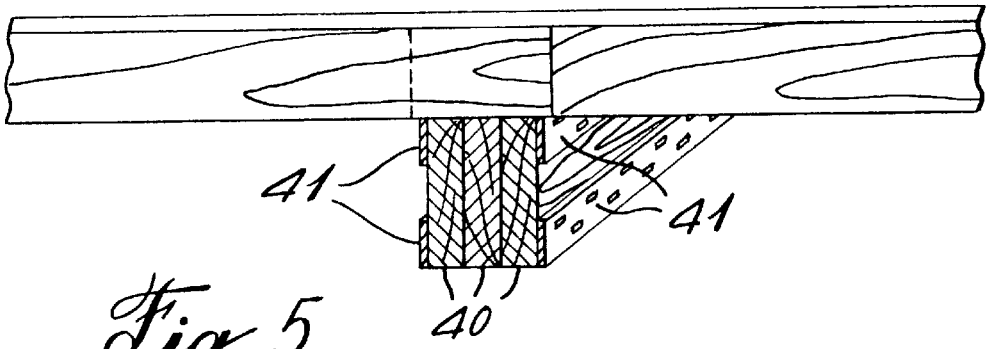
FIG. 5 is a partial perspective view of a floor structure comprising a reinforced wood girder in accordance with the present invention.

As shown in FIG. 5, girders such as 40 can be reinforced by means of four strips 41 of sheet metal as described hereinabove.

Figure 6:
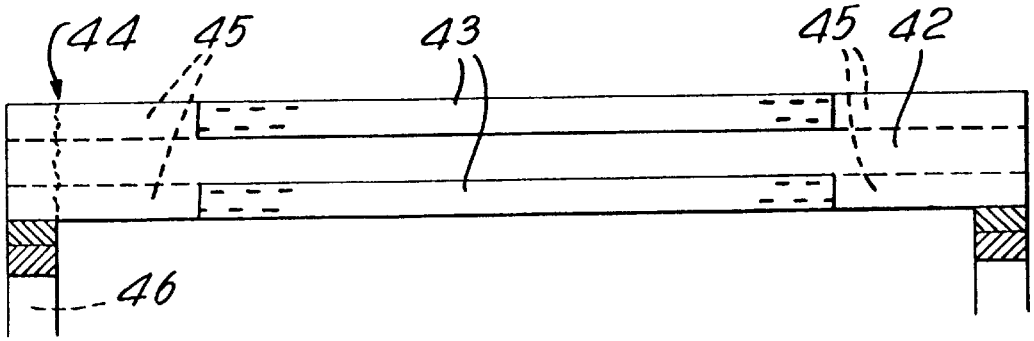
FIG. 6 is a side elevational view of a further embodiment of reinforced wood joist in accordance with the present invention.

FIG. 6 illustrates that a wood joist or girder such as 42 supported at the two ends thereof can be reinforced by sheet metal strips such as 43 mounted only in the central portion thereof where the bending stresses are concentrated. However, it should be kept in mind that full-length strips 43 (see dashed lines 45 in FIG. 6) will also greatly increase the shearing resistance of the joist or girder 42 in the region (see 44 in FIG. 6) of the post or wall such as 46 supporting the corresponding end of that joist or girder 42.

Although the above description is directed mainly to the reinforcement of joists made of wood, it should be kept in mind that the concept of steel-wood system in accordance with the present invention is also applicable to any other type of elongated structural wood members, for example those used for constructing the walls, trusses and other structures of a building. For example, the concept of steel-wood system may be used to reinforce elongated structural wood members subjected to direct tension (for example the braces of a truss), or to direct compression (for example the braces of a truss or the studs of a wall), direct shearing (for examples the ends of an horizontal wood beams supported by two posts or walls) and any combination thereof. It is also within the scope of the present invention to use the steel-wood system to reinforce any type of reconstituted wood.

To understand the concept of reinforced wood, one should know that most of wood species are weaker in tension than in compression, as concrete is. When wood is reinforced, the tension and compression stresses are supported by the metal of the reinforcing strips to improve the mechanical performance of the wood member. Use of reinforcing sheet metal strips (steel) such as 11–14 will easily multiply the resistance of an elongated structural wood member to compression, tension, bending, crushing and shearing by 1.5 to 2.

Figure 7:
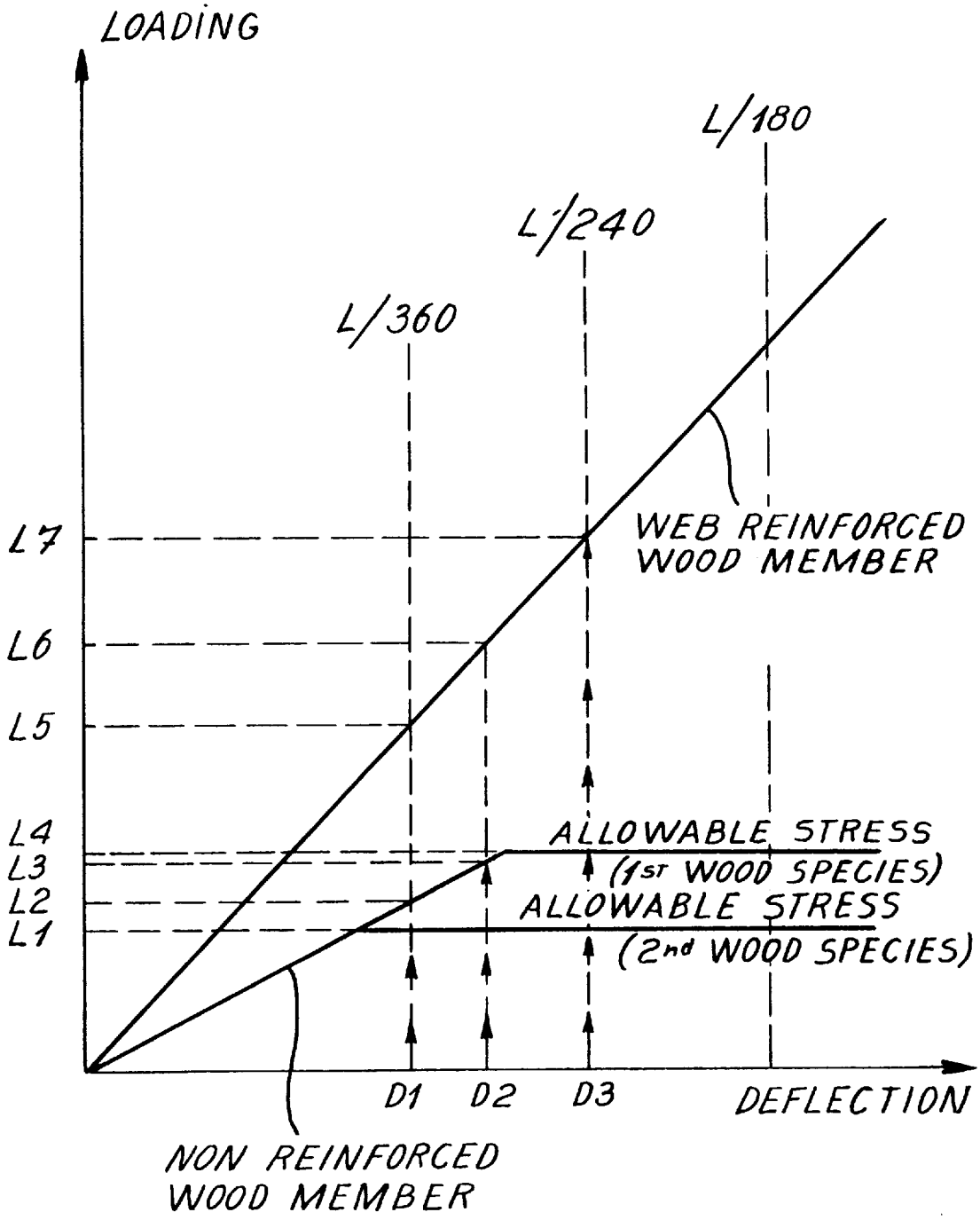
FIG. 7 is a graph comparing the load that can be supported by a reinforced wood joist as illustrated in FIG. 1 to the load that can be supported by the same, but non reinforced wood joist.

The graph of FIG. 7 and the following Table 1 indicates that:

- a load as low as $L_1$ or $L_2$, depending on the wood species, is sufficient to cause a deflection (bending) $D_1$ (L/360) in a non reinforced wood member, for example a joist of the type as shown in FIG. 1, while a load $L_5$, well higher than the load $L_1$ or $L_2$ and independent from the wood species, is required to produce the same deflection $D_1$ (L/360) in a web-reinforced wood member, for example a web-reinforced joist as illustrated in FIG. 1;
- a load as low as $L_1$ or $L_3$, depending on the wood species, is sufficient to cause a deflection $D_2$ in the non reinforced wood member, while a load $L_6$, well higher than the load $L_1$ or $L_3$ and independent from the wood species, is required to produce the same deflection $D_2$ in the web-reinforced wood member; and
- a load as low as $L_1$ or $L_4$, depending on the wood species, is sufficient to cause a deflection $D_3$ (L/240) in the non reinforced wood member, while a load $L_7$, well higher than the load $L_1$ or $L_4$ and independent from the wood species, is required to produce the same deflection $D_3$ (L/240) in the web-reinforced wood member.

| Deflexion | Load on non reinforced wood member | Load on web-reinforced wood member |
|---|---|---|
| $D_1$ (L/360) | $L_1$ or $L_2$ | $L_5$ |
| $D_2$ | $L_1$ or $L_3$ | $L_6$ |
| $D_3$ (L/240) | $L_1$ or $L_4$ | $L_7$ |

Therefore, the graph of FIG. 7 and Table 1 show that the load that can be supported by a non reinforced wood member is limited to the allowable stress which is dependent on the wood species. On the contrary, a web-reinforced wood member has no allowable stress limit and greatly increases the load required to cause the same deflection or bending into the wood member. Also, this load becomes independent from the wood species.

Of course, depending on the particular application of the elongated structural wood member, sheet metal strips can be placed as required on the web surfaces to reinforce the wood member either in tension, compression, shearing, bending and any combination thereof. Therefore, a plurality of different combinations of sheet metal strips are possible. Five examples of combinations of sheet metal strips 47 applied to the web surfaces of an elongated structural wood member 48 are illustrated in FIGS. 8*a*, 8*b*, 8*c*, 8*d* and 8*e*. The strips 47 should be considered as "reinforcing rods" as those used for reinforcing concrete and calculated in accordance with the requirements of the intended application, taking into consideration the amplitude of the load, the span, the dimensions of the cross section of the wood member, the wood specie, etc.

In the above description, the strips 11–14 are described as being made of sheet metal. Of course, it is within the scope of the present invention to use metals or metallic alloys other than steel.

Web-reinforcement of an elongated structural wood member by means of, for example, sheet metal strips as taught in the foregoing description presents, amongst others, the following advantages:

- the surface available for web-reinforcing an elongated structural wood member having a rectangular cross section is larger;
- the sheet metal strips can be installed on the site to reinforce an already erected structure;
- in the case of a generally horizontal joist, there is no reinforcement on the top and bottom surfaces whereby conventional methods can still be used for building the floor and ceiling;
- web-reinforcing an elongated structural wood member in accordance with the method of the invention compensates for the natural defects of wood, such as:
  (A) shrinkage;
  (B) cracks;
  (C) localized weakness caused by knots;
  (D) wane, including wane edge;
  (E) skips;
  (F) checks and shakes;
  (G) resin pockets;
  (H) pulled grain;
  (I) resin streaks;
  (J) grain deviation;
  (K) ring shakes;
  (L) holes;
  (M) alveolar decay;
  (N) curvature;
  etc.
- web-reinforcing strips mounted on the web surfaces increases the resistance of an elongated structural wood member to shearing;
- sheet metal strips mounted on the web surfaces reinforce the periphery of any opening made into the elongated structural wood member for passing electrical wires or water conduits;
- reinforcing strips can be mounted onto the web surfaces of already installed structural wood members in order to improve their mechanical resistance;
- different shapes, width and/or thicknesses of sheet metal strips can be applied to the web surfaces without causing any lifting of the structures nailed or screwed to the edge surfaces of the elongated structural wood member;
- reinforcing strips applied to the web surfaces efficiently damp the vibratory and oscillatory phenomenons inherent to the long span floor structures;
- reinforcing strips applied to the web surfaces protect against deflection, shearing and vibration elongated structural wood members such as open joists and composite joists;
- reinforcing strips applied to the web surfaces enable sawing of wood members of smaller width and thickness, for example of dimensions width and thickness reduced by 8–10%, to thereby save large quantities of wood; the loss of mechanical resistance caused by the reduced width and thickness of the wood member is compensated by the reinforcing strips that still increase the mechanical strength of the wood member by 50% to 100% in comparison to a non reinforced wood member having non reduced dimensions;
- downgrading due to defects of the wood can be easily overcome by installing sheet metal strips in accordance with the invention, to thereby save large quantities of wood.

Although the present invention has been described hereinabove with reference to preferred embodiments thereof, these embodiments can be modified at will, within the scope of the appended claims, without departing from the spirit and nature of the subject invention.

What is claimed is:

1. A web-reinforced structural member comprising an elongated solid wood member defining a first edge surface, a second edge surface opposite to the first edge surface, a first lateral web surface, a second lateral web surface opposite to the first lateral web surface, a first longitudinal 90° edge connecting the first edge surface to the first lateral web surface, a second longitudinal 90° edge connecting the first edge surface to the second lateral web surface, a third longitudinal 90° edge connecting the second edge surface to the first lateral web surface, and a fourth longitudinal 90° edge connecting the second edge surface to the second lateral web surface, said web-reinforced structural member further comprising:

a first longitudinal metal reinforcement strip applied to said first lateral web surface adjacent to said first longitudinal 90° edge over a substantial portion of the length of the wood member, said first metal reinforcement strip comprising integral metal teeth distributed at predetermined intervals along said first metal reinforcement strip and driven into the wood of said wood member to fixedly secure said first metal reinforcement strip to the wood of said wood member;

a second longitudinal metal reinforcement strip applied to said second lateral web surface adjacent to said second longitudinal 90° edge over a substantial portion of the length of the wood member, said second metal reinforcement strip comprising integral metal teeth distributed at predetermined intervals along said second metal reinforcement strip and driven into the wood of said wood member to fixedly secure said second metal reinforcement strip to the wood of said wood member;

a third longitudinal metal reinforcement strip applied to said first lateral web surface adjacent to said third longitudinal 90° edge over a substantial portion of the length of the wood member, said third metal reinforcement strip comprising integral metal teeth distributed at predetermined intervals along said third metal reinforcement strip and driven into the wood of said wood member to fixedly secure said third metal reinforcement strip to the wood of said wood member; and a fourth longitudinal metal reinforcement strip applied to said second lateral web surface adjacent to said fourth longitudinal 90° edge over a substantial portion of the length of the wood member, said fourth metal reinforcement strip comprising integral metal teeth distributed at predetermined intervals along said fourth metal reinforcement strip and driven into the wood of said wood member to fixedly secure said fourth metal reinforcement strip to the wood of said wood member.

2. The web-reinforced structural member as recited in claim 1, wherein the first, second, third and fourth longitudinal metal reinforcement strips comprise first, second, third and fourth longitudinal sheet metal reinforcement strips, respectively.

3. The web-reinforced structural member as recited in claim 2, wherein said first longitudinal sheet metal reinforcement strip has a longitudinal edge adjacent to said first longitudinal 90° edge, said second longitudinal sheet metal reinforcement strip has a longitudinal edge adjacent to said second longitudinal 90° edge, said third longitudinal sheet metal reinforcement strip has a longitudinal edge adjacent to said third longitudinal 90° edge, and said fourth longitudinal sheet metal reinforcement strip has a longitudinal edge adjacent to said fourth longitudinal 90° edge.

4. The web-reinforced structural member as recited in claim 1, wherein the first, second, third and fourth metal reinforcement strips are made of sheet metal, and wherein the teeth are stamped in said sheet metal.

5. The web-reinforced structural member as recited in claim 4, in which each of said teeth comprises a generally diagonal sawtooth edge.

6. A method for web-reinforcing an elongated solid wood member defining a first edge surface, a second edge surface opposite to the first edge surface, a first lateral web surface, a second lateral web surface opposite to the first lateral web surface, a first longitudinal 90° edge connecting the first edge surface to the first lateral web surface, a second longitudinal 90° edge connecting the first edge surface to the second lateral web surface, a third longitudinal 90° edge connecting the second edge surface to the first lateral web surface, and a fourth longitudinal 90° edge connecting the second edge surface to the second lateral web surface, said wood member web-reinforcing method comprising the steps of:

applying a first longitudinal metal reinforcement strip to said first lateral web surface adjacent to said first longitudinal 90° edge over a substantial portion of the length of the wood member, and fixedly securing said first metal reinforcement strip to the wood of said member at predetermined intervals along the length of said first metal reinforcement strip by means of metal teeth integral to said first metal reinforcement strip and driven into the wood of said member;

applying a second longitudinal metal reinforcement strip to said second lateral web surface adjacent to said second longitudinal 90° edge over a substantial portion of the length of the wood member, and fixedly securing said second metal reinforcement strip to the wood of said member at predetermined intervals along the length of said second metal reinforcement strip by means of metal teeth integral to said second metal reinforcement strip and driven into the wood of said member;

applying a third longitudinal metal reinforcement strip to said first lateral web surface adjacent to said third longitudinal 90° edge over a substantial portion of the length of the wood member, and fixedly securing said third metal reinforcement strip to the wood of said member at predetermined intervals along the length of said third metal reinforcement strip by means of metal teeth integral to said third metal reinforcement strip and driven into the wood of said member; and applying a fourth longitudinal metal reinforcement strip to said second lateral web surface adjacent to said fourth longitudinal 90° edge over a substantial portion of the length of the wood member, and fixedly securing said fourth metal reinforcement strip to the wood of said member at predetermined intervals along the length of said fourth metal reinforcement strip by means of metal teeth integral to said fourth metal reinforcement strip and driven into the wood of said member.

7. The wood member web-reinforcing method as defined in claim 6, wherein said first, second, third and fourth longitudinal metal reinforcement strips comprise first, second, third and fourth longitudinal sheet metal reinforcement strip, respectively, and wherein:

the step of applying a first longitudinal sheet metal reinforcement strip to said first lateral web surface comprises placing a longitudinal edge of the first sheet metal reinforcement strip adjacent to said first longitudinal 90° edge;

the step of applying a second longitudinal sheet metal reinforcement strip to said second lateral web surface comprises placing a longitudinal edge of the second sheet metal reinforcement strip adjacent to said second longitudinal 90° edge;

the step of applying a third longitudinal sheet metal reinforcement strip to said first lateral web surface comprises placing a longitudinal edge of the third sheet metal reinforcement strip adjacent to said third longitudinal 90° edge; and the step of applying a fourth longitudinal sheet metal reinforcement strip to said second lateral web surface comprises placing a longitudinal edge of the fourth sheet metal reinforcement strip adjacent to said fourth longitudinal 90° edge.

* * * * *